US006296519B1

(12) United States Patent
Hashizawa et al.

(10) Patent No.: US 6,296,519 B1
(45) **Date of Patent: *Oct. 2, 2001**

(54) SHIELDED CONNECTOR

(75) Inventors: Shigemi Hashizawa; Hidehiko Kuboshima, both of Shizuoka; Junzo Ohe; Toshio Asahi, both of Aichi, all of (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/175,951

(22) Filed: Oct. 21, 1998

(30) Foreign Application Priority Data

Oct. 21, 1997 (JP) ..... 9-288669

(51) Int. Cl.[7] ..... H01R 13/658
(52) U.S. Cl. ..... 439/607; 439/851
(58) Field of Search ..... 439/607–610, 439/947.2

(56) References Cited

U.S. PATENT DOCUMENTS 4,239,318 * 12/1980 Schwartz ..... 439/609
4,426,127 * 1/1984 Kubota ..... 439/609
4,720,157 * 1/1988 Nestor et al. ..... 439/851
4,749,357 * 6/1988 Foley ..... 439/947.2
4,983,127 * 1/1991 Kawai et al. ..... 439/609
5,035,650 * 7/1991 Dijihaugh et al. ..... 439/609
5,055,055 * 10/1991 Bakker ..... 439/947.2
5,509,823 * 4/1996 Harting et al. ..... 439/607
5,932,841 * 8/1999 Matsumoto et al. ..... 439/609

FOREIGN PATENT DOCUMENTS 5-258804 10/1993 (JP) ..... H01R/13/648
8-241763 9/1996 (JP) ..... H01R/13/648
9-8489 1/1997 (JP) ..... H05K/9/00

* cited by examiner

*Primary Examiner*—Hien Vu
(74) *Attorney, Agent, or Firm*—Sughrue, Mion, Zinn, Macpeak & Seas, PLLC

(57) ABSTRACT

In a shielded connector having a connector housing subjected to conductive electroplating, a conductive shield ring is fitted into a housing chamber of the connector housing and a partner-side shield contact portion is inserted into the inside of the shield ring. The shield contact has resilient contact pieces and is slidable within a predetermined range within the shield ring. The shield contact has a split portion so that is has resilience in the diameter expanding direction thereof. The shield contact is locked with the shield ring. A pressure-insertion space is formed within the housing chamber and the shield ring is provided with pressure-insertion portions.

10 Claims, 4 Drawing Sheets

SHIELDED CONNECTOR

BACKGROUND OF THE INVENTION

1. Field of the Invention

The present invention relates to a shielded connector for shielding electromagnetic waves used in an electric car or the like. More particularly, the present invention relates to a shielded connector in which the configuration of the contact portion contacting with a partner-side shield contact portion is contrived.

The present application is based on Japanese Patent Application No. Hei. 9-288669, which is incorporated herein by reference.

2. Description of the Related Art

FIG. 6 shows a male side shielded connector 45 and a female side shielded connector 46 which are similar to conventional shielded connectors disclosed by Unexamined Japanese Patent Publication No. Hei. 8-241763.

The respective shielded connectors 45, 46 include connector housings 47, 48 made of synthetic resin, metal shells 49, 50 housed within the connector housings 47, 48, and terminals 51, 52 positioned within the metal shells 49, 50, respectively.

The connector housings 47, 48 include inner housings 53, 54 and outer housings 55, 56, respectively. The metal shells 49, 50 are disposed along the outer sides of the inner housings 53, 54, respectively. At the tip end sides of the metal shells 49, 50, slit-shaped notch portions 57, 58 are formed and further circumferentially arc-shaped projection plate portions 59, 60 are formed adjacent to the notch portions 57, 58, respectively. The projection plate portions 59, 60 protrude to the connector attachment direction through the spaces between the outer housings 55, 56 and the inner housings 53, 54, respectively.

The rear end portions of the metal shells 49, 50 are coupled to braided wires 63, 64 of shielded electric wires 61, 62, respectively. The terminals 51, 52 are coupled to the tip portions of the shielded electric wires 61, 62 through caulking process, respectively. The shielded electric wires 61, 62 are drawn to the rear sides of the connector housings 47, 48, respectively.

Both the shielded connectors 45, 46 are attached together and, simultaneously, both the metal shells 49, 50 are attached and connected together. The projection plate portion 59 of one of the metal shells, that is, the metal shell 49 covers the notch portion 58 of the other metal shell 50, and the other projection plate portion 60 is inserted into the inside of a hook piece 65 of the metal shell 49. Accordingly, the projection plate portion is prevented from being lifted and the metal shells 49, 50 are attached tightly. Further, since the terminals 51, 52 serving as conductive portions are mainly covered by the metal shells 50, 49, respectively, the terminals are shielded from electromagnetic wave.

However, the aforementioned conventional arrangement has the following problems. That is, the size of the connector itself becomes larger since the metal shells 49, 50 are housed within the connector housings 47, 48, respectively. Further, because the mounting space for the metal shells 49, 50 and the extracting direction of the electric wires or the like are restricted, there remains portions which can not be covered by the metal shells 49, 50. Further the metal shells 49, 50 are complicated in their structure and the assembling workability thereof is degraded.

In order to solve the above problems, a shielded connector in which connector housings entirely subjected to the conductive electroplating is employed in place of the metal shells has been proposed by, for example, Unexamined Japanese Patent Publication Nos. Hei. 5-258804 and Hei. 9-8489. In such a shielded connector, the electroplated layer may be removed in the case where prying force is applied at the time of attaching the male and female connectors together and in the case where the connector housings are slid with pressure to each other in order to electrically connect the connector housings.

SUMMARY OF THE INVENTION

In view of the aforementioned problems, an object of the present invention is to provide a shielded connector which can prevent the enlargement of the size of the connector itself and the degradation of the assembling workability of the metal shell etc., and also prevent the removal of the electroplated layer and the degradation of electric contact performance in the electroplated connector housings.

In order to achieve the aforementioned object, according to the present invention, there is provided a shielded connector which comprises: a connector housing subjected to conductive electroplating, the connector housing including a housing chamber; and a conductive shield ring, into which a shield contact portion of a partner-side shielded connector is insertable, fitted into the housing chamber, the shield ring contacting with the conductive electroplating of the connector housing.

It is also effective that the above shielded connector further comprises a conductive shield contact fittable to an inside of the shield ring, the shield contact contacting with the shield contact portion of the partner-side shielded connector when the shield contact portion of the partner-side shielded connector is inserted into the shield ring. It is also effective that the shield contact has resilient contact pieces. It is also effective that the shield contact is slidable in a predetermined range within the shield ring.

Furthermore, it is also effective that the shield contact has an annular shape, and includes a split portion providing resilience to the shield contact in a direction to which a diameter of the shield contact expands. It is also effective that the shield contact and the shield ring include locking mechanisms, respectively. It is also effective that a pressure-insertion space is formed within the housing chamber, and a pressure insertion portion for the pressure-insertion space is formed on the shield ring.

DETAILED DESCRIPTION OF THE PREFERRED EMBODIMENT

Figure 1:
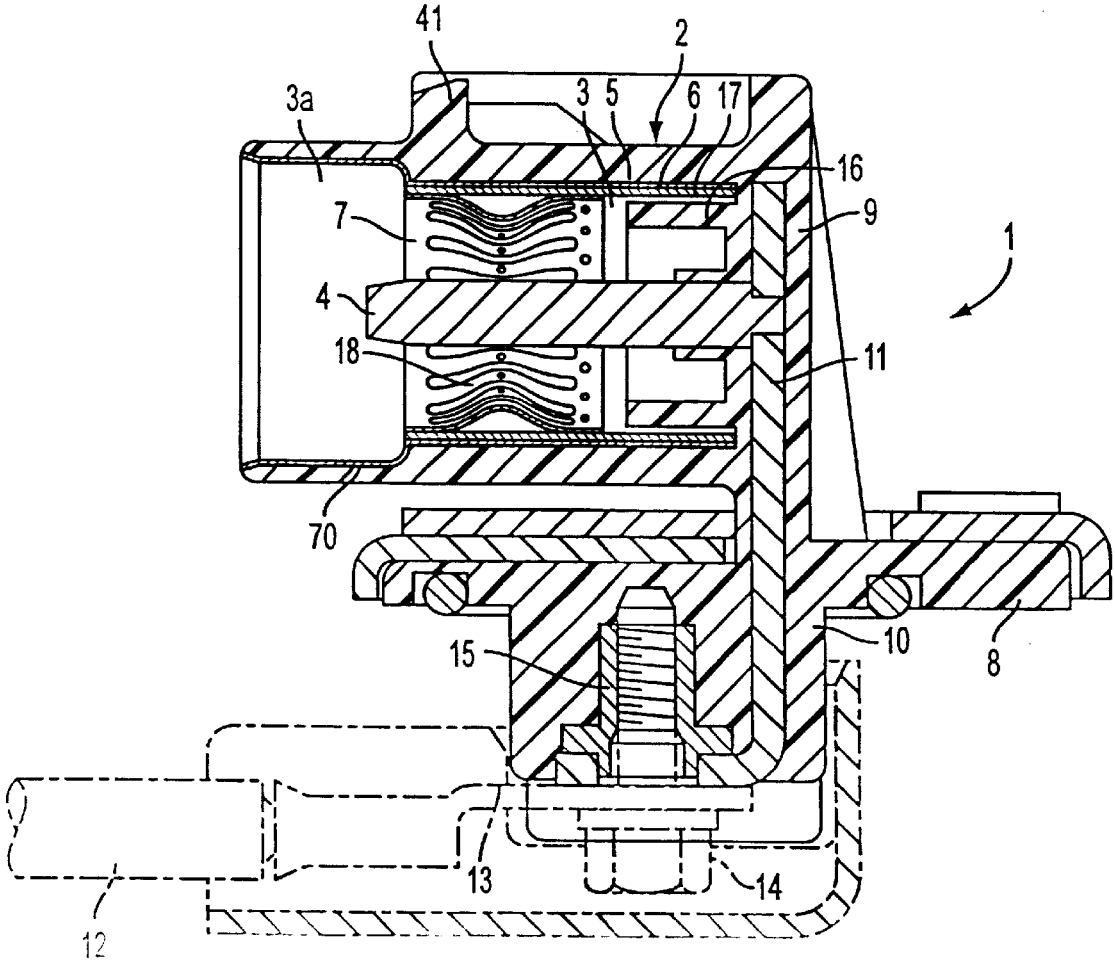
FIG. 1 is a longitudinal sectional view showing an embodiment of a shielded connector according to the present invention.

Embodiments of the present invention will be described with reference to FIGS. 1 to 5.

The shielded connector 1 includes a female connector housing 2 made of synthetic resin and subjected to the conductive electroplating to form a conductive electroplating layer 70, a male terminal 4 protruding at the center portion of the housing chamber 3 of the female connector housing 2, a shield ring 6 made of conductive metal and fitted along the inner peripheral wall 5 of the housing chamber 3, and an annular shield contact 7 made of conductive metal and fitted within the shied ring 6.

The conductive electroplating layer 70 is effected on both the main and rear surfaces of the female connector housing 2. The female connector housing 2 has a cylindrical configuration and a pair of such female connector housings 2 are disposed in parallel (FIG. 1 shows only one of the pair of the female connector housings 2). A base plate portion 8 for directly mounting a device thereon is integrally formed with the female connector housing 2. The conductive electroplating layer 70 is also effected on both the main and rear surfaces of the base plate portion 8. This conductive electroplating is effected by using copper and tin, preferably. The conductive electroplating in this case is performed in a manner that, firstly, the connector housing 2 made of synthetic resin is partially etched away, then the male terminal 4 is subjected to the masking process so as not to be grounded, then the connector housing is subjected to the copper electroplating and thereafter the tin electroplating.

A conductive metal plate 11 is provided to extend vertically from the rear wall 9 of the female connector housing 2 to a base portion 10 at the lower side of the base plate portion through the base plate portion 8. One end portion of the conductive metal plate 11 is coupled to the male terminal 4 within the female connector housing 2, and the other terminal of the. conductive metal plate 11 is bent to the horizontal direction and coupled to a current supply electric wire 12. A terminal 13 is coupled to the electric wire 12. The terminal 13 is coupled and fastened with the other terminal of the conductive metal plate 11 by using a bolt 14 and a nut 15. The electric wire 12 is extracted to the same direction as the extracting direction of the male terminal 4 within the female connector housing 2. The extracting direction of the electric wire 12 can be set freely by changing the configuration of the other end portion of the conductive metal plate 11.

The shield ring 6 is fitted into the female connector housing 2 with pressure along the outside of the male terminal 4, that is, along the inner peripheral wall 5 of the female connector housing. The tip end portion of the male terminal 4 protrudes slightly to the forward direction from the front end of the shield contact 7. The housing chamber 3 of the female connector housing 2 is configured to have a step potion thereby to form a large diameter portion 3*a* at the front portion thereof and a small diameter portion. The shield ring 6 is fitted with pressure into the small diameter portion side of the housing chamber 3. A fitting-in annular portion 16 is formed at the bottom portion of the housing chamber 3 so as to protrude therefrom. The shield ring 6 is fitted with pressure into a space 17 between the annular portion 16 and the inner peripheral wall 5 of the housing chamber 3.

Figure 2:
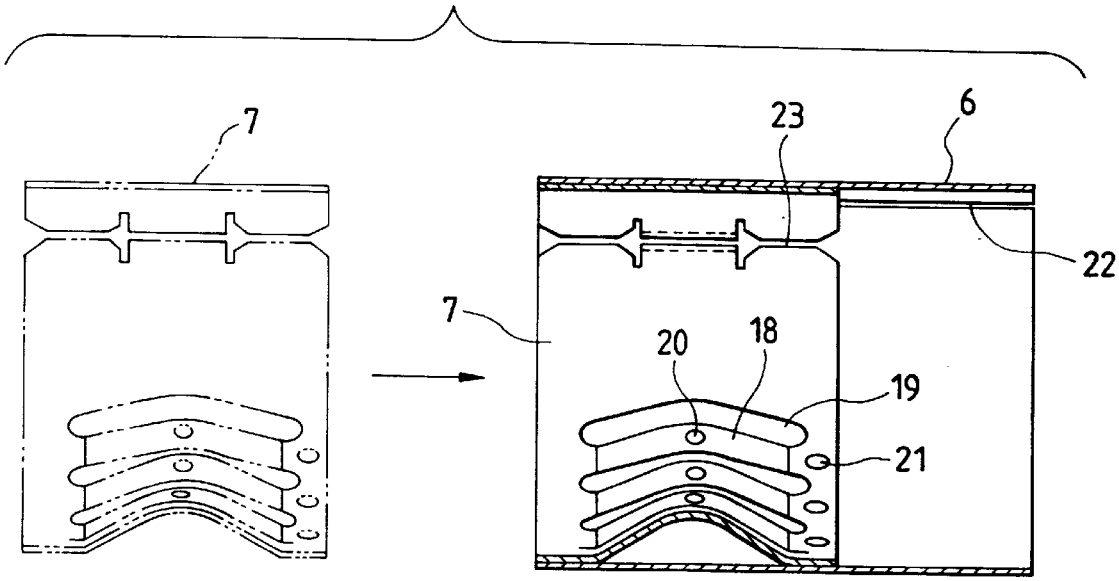
FIG. 2 is a longitudinal sectional view showing a state where a shield contact is fitted into a shield ring.

As shown in FIG. 2, the annular shield contact 7 is fitted into the inner side of the shield ring 6. The annular shield contact 7 is formed to have a length slightly longer than the half of the length of the shield ring 6. The annular shield contact has a plurality of resilient contact pieces 18 formed on the circumference thereof and extending to the axial direction thereof, that is, to the engagement direction of the connector. Each of the resilient contact pieces 18 is formed between adjacent slits 19 to protrude inward in a substantially mountain shape so that the resilient contact pieces are capable of contacting the shield contact portion of a partner-side shielded connector described below (see FIG. 5). Contact projections 20 are formed on the resilient contact pieces 18 so as to protrude inward. Contact projections 21 for the shield ring 6 are formed at the insertion-side end portion of the shield contact 7 so as to protrude outward.

The shield ring 6 and the shield contact 7 have slit-shaped split portions (coupling portions) 22, 23 extending to the axial direction thereof, respectively. The external diameter size of the shield contact 7 in its free state (state before the attachment) is set to be larger than the inner diameter size of the shield ring 6 in its free state. The shield contact 7 has resilience in the diameter direction thereof. The shield ring 6 also has resilience in the diameter direction thereof. The shield contact 7 is mounted so as to be freely slidable in a predetermined range to the axial direction (longitudinal direction) and the circumferential direction thereof within the shield ring 6.

Figure 3:
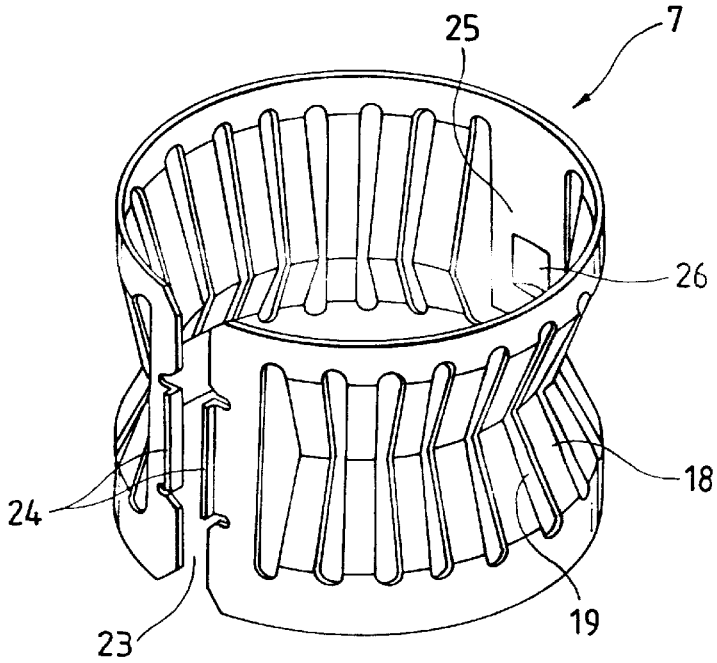
FIG. 3 is a perspective view showing an example of the shield contact.

FIG. 3 shows an example of the shield contact (in which the same parts as those of FIG. 2 are labeled with the same reference numerals). A pair of locking nail portions 24 (locking mechanism) are formed at the split portion 23 of the shield contact 7 so as to bend outward. A flexible locking piece 25 extending to the axial direction of the shield contact is formed at the portion of the shield contact 7 that is opposite to the locking nail portions 24 by 180 degrees. A locking projection (locking mechanism) 26 is formed at the flexible locking piece 25 so as to swell outward. Each of the resilient contact pieces 18 is formed between the axially extending adjacent slits 19 so as to protrude inward. The shield contact 7 is formed of resilient conductive metal material. The shield contact 7 actually extends in the free state thereof to a larger extent outward than the state shown in the figure in a manner that the split portion 23 opens widely. In FIG. 3, the illustration of the contact projections are omitted.

Figure 4:
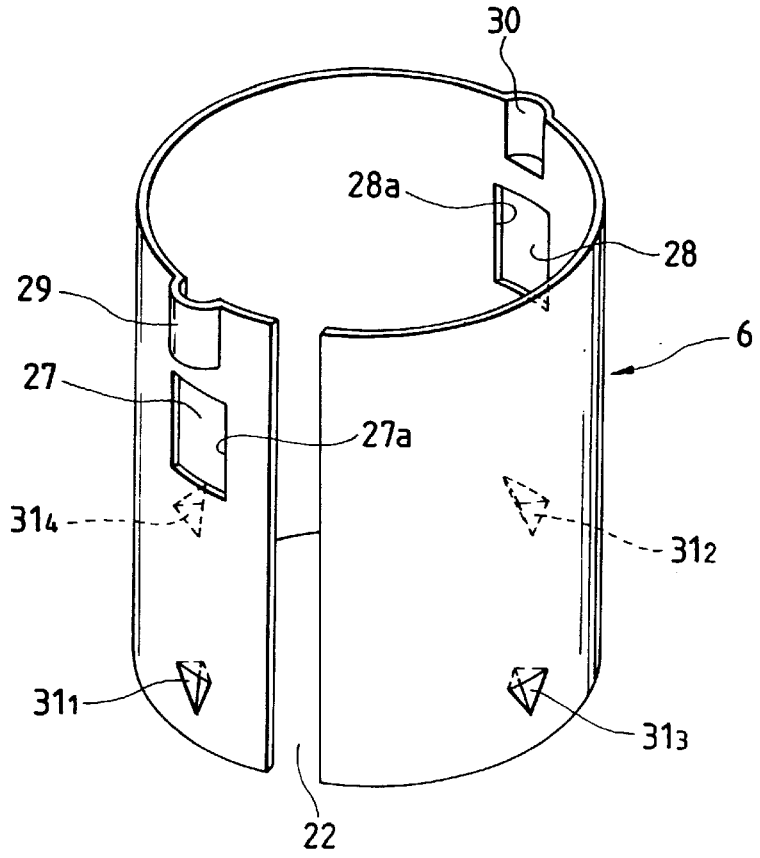
FIG. 4 is a perspective view showing the shield ring.

FIG. 4 shows an example of the shield ring in which the same parts as those of FIG. 2 are labeled with the same reference numerals. Engagement holes (locking mechanism) 27, 28 are provided at two portions on the circumferential surface of the shield ring 6 so as to oppose to the locking nail portions 24 and the locking projection 26 of the shield contact 7 (see FIG. 3), respectively. Positioning projection portions 29, 30 for the connector housing 2 (see FIG. 1) are formed at the upper portions of the engagement holes 27, 28 of the shield ring so as to swell outward, respectively. Positioning and surely-pressing-in projection portions 31 ($\mathbf{31}_1$ to $\mathbf{31}_4$) are formed beneath the engagement holes 27, 28 of the shield ring so as to swell inward, respectively. The shield ring 6 is formed of conductive metal material such as brass.

The shield contact 7 is shrunk to the diameter direction thereof and inserted within the shield ring 6 thereby to engage the locking nail portions 24 and the locking projection 26 with the engagement holes 27, 28, respectively. The locking nail portions 24 and the locking projection 26 may be engaged with the engagement holes 27, 28 or 28, 27, respectively. Then, the shield contact 7 expands within the shield ring 6 and is locked with the shield ring since the locking nail portions 24 are hooked at the side end portions 27*a* (28*a*) of the engagement hole 27 (28).

The locking projection 26 is movable freely within the engagement hole 27 (28). The locking nail portions 24 are movable freely to the circumferential direction of the shield contact within the engagement hole 27. When the longitudinal length of the locking nail portions 24 is made shorter than that shown in FIG. 3, the locking nail portions 24 become movable freely within the engagement hole 27 also to the axial direction of the shield contact. In this case, when the shield ring into which the shield contact is fitted is attached to the connector housing 2, the shield contact 7 is slidable within the shield ring 6 both to the circumferential and axial direction of the shield contact. As a consequence, the shield contact 7 absorbs the attaching force or prying force of the partner-side shield contact portion (see FIG. 5) thereby to prevent the movement (deviation) of the shield ring 6.

The shield ring 6 is fitted with pressure into the housing chamber 3 of the connector housing 2 (see FIG. 1) in a sub-assy (sub-assembling) state of the shield ring 6 and the shielded connector 7. Alternatively, of course, it is possible to fit the shield contact 7 within the shield ring after fitting the shield ring 6 within the housing chamber with pressure. In the case where the shield ring 6 is not provided and only the shield contact 7 is fitted into the housing chamber 3 with pressure, the resilient contact pieces 18 may be deformed at the time of the fitting procedure. However, such deformation of the resilient contact pieces 18 can be prevented by fitting the shield contact 7 into the shield ring 6 and then fitting the shield ring 6 into the housing chamber.

The positioning projection portions 29, 30 and the two projection portions $\mathbf{31}_4$, $\mathbf{31}_2$ positioned beneath the positioning projection portions 29, 30 of the shield ring 6 engage with axially extending guide grooves (not shown) of the inner peripheral wall 5 of the housing chamber of the connector housing 2 (see FIG. 1). The other two projection portions (pressure-insertion portions) $\mathbf{31}_3$, $\mathbf{31}_1$ are fitted with a large force into the space 17 between the annular portion 16 within the housing chamber 3 and the inner peripheral wall 5 of the housing chamber thereby to surely fix the shield ring 6 within the housing chamber 3. The locking nail portions 24 and the locking projection 26 of the shield contact 7 are positioned within the guide grooves (not shown) of the housing chamber 3.

Figure 5:
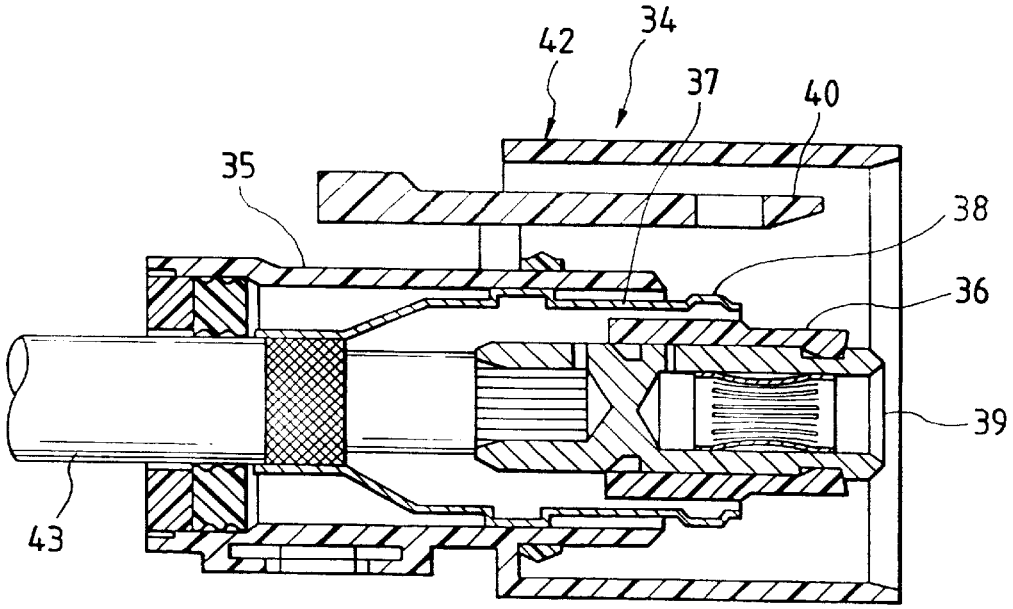
FIG. 5 is a longitudinal sectional view showing an example of a partner-side shielded connector.
Figure 6:
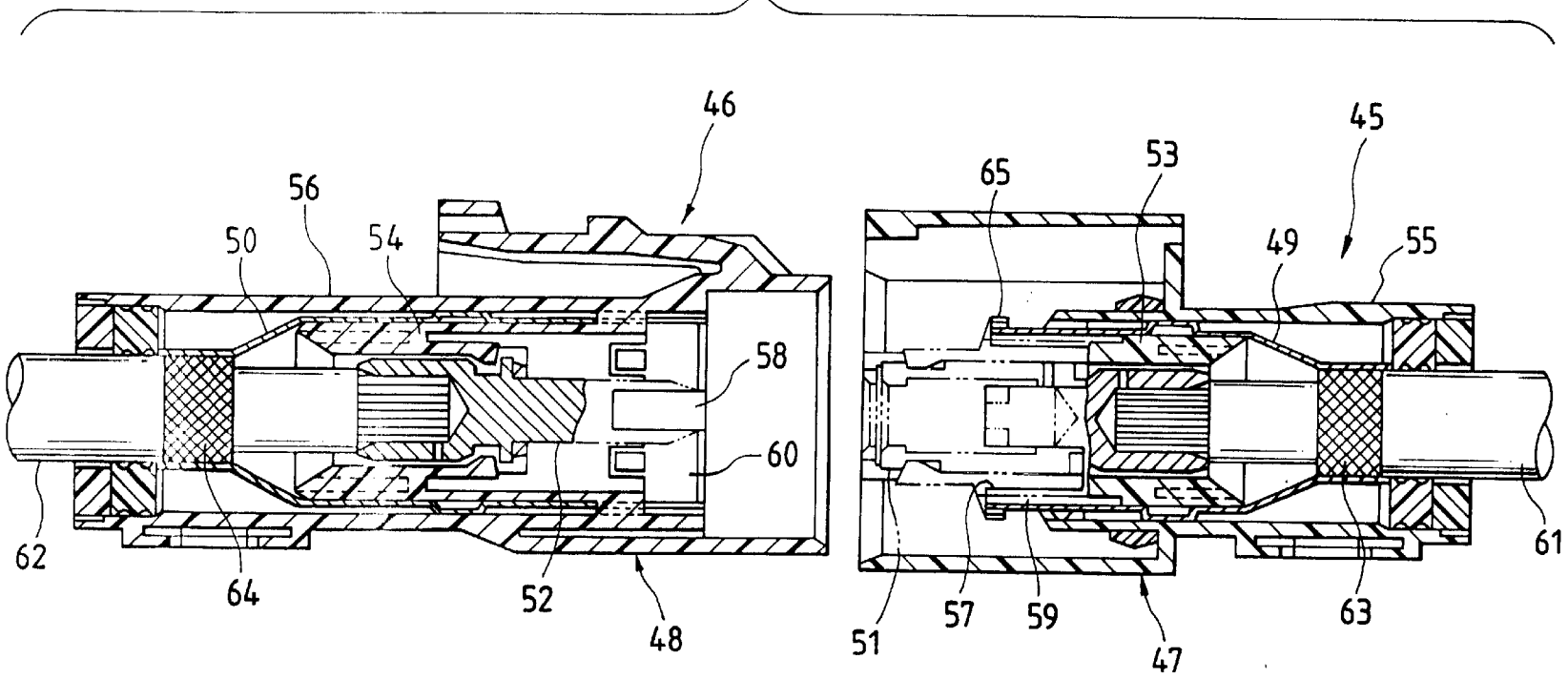
FIG. 6 PRIOR ART
FIG. 6 is a longitudinal sectional view showing an example of conventional shielded connector.

FIG. 5 shows a male side shielded connector for the female side shielded connector 1 of FIG. 1.

The male side shielded connector 34 is a known one which is arranged in a manner that a metal shell 37 is disposed at the inside of a connector housing 42 made of synthetic resin, that is, between an outer housing 35 and an inner housing 36 and a female terminal 39 is provided at the inside of the inner housing 36.

The tip end portion of the metal shell 37 protrudes from the front end of the outer housing 35 thereby to form an annular shield contact portion (partner-side shield contact portion) 38. When both the male and female shielded connectors 1 (see FIG. 1), 34 are attached to each other, simultaneously, the shield contact portion 38 is fitted into the inside of the shield contact 7 of the shielded connector 1 and contacts with the resilient contact pieces 18. At the same time, the male terminal 4 is fitted into the female terminal 39. The locking arm 40 engages with the locking projection 41. Thus, the shield contact portion 38 can be stably coupled with the shield contact by the contact pressure of the resilient contact pieces 18.

In FIG. 1, when the connectors are fitted to each other, since the shield contact 7 can be slid to the axial and circumferential direction in a predetermined range within the shield ring 6, the fitting force or prying force generated at the time of attaching the connectors can be absorbed. Thus, the deformation and movement (deviation) of the shield ring 6 within the connector housing 2 can be suppressed. Accordingly, since there is no friction between the shield ring 6 and the conductive electroplated layer (not shown), the removal of the electroplated layer can be prevented. Further, since the removal of the electroplated layer is prevented, good shielding effect can be kept. Furthermore, since the shield ring 6 makes surface-contact with the inner peripheral wall 5 of the housing chamber, the spring load of the shield contact 7 can be dispersed by the shield ring 6, and the inner peripheral wall 5 of the housing chamber can be prevented from being subjected to chronological deformation or the like.

The shield contact 7 contacts with the shield ring 6 and the shield ring 6 contacts with the conductive electroplated layer of the inner peripheral wall 5 of the housing chamber of the connector housing 2, and further the conductive electroplated layer of the inner peripheral wall 5 of the housing chamber continues to the conductive electroplated layer of the base plate portion 8 for directly mounting a device thereon. Accordingly, the electromagnetic wave on the shielded connector 1 side can be surely grounded to the device side, and further the electromagnetic wave on the device side can be surely grounded to a shielded electric wire 43 of the partner-side shielded connector 34 (see FIG. 5) through the shield contact 7 of the shielded connector 1.

Instead of the configuration of the aforementioned embodiment, the present invention may be configured in a manner that only the shield ring 6 is fitted into the housing chamber 3 of the connector housing 2 and the partner-side shield contact portion 38 is directly coupled with the shield ring 6. Further, it is possible to integrally form the resilient contact pieces 18 with the shield ring 6 by contriving the configuration and the pressure-insertion method of the shield ring. Furthermore, it is possible to integrally form the shield contact portion 38 of the partner-side male side shielded connector 34 with the resilient contact portion.

As described above, according to the present invention, since the partner-side shield contact portion slidably contacts with the shield ring and not with the connector housing, the removal of the electroplated layer is prevented and good shielding performance can be ensured. According to the present invention, since the partner-side shield contact portion slidably contacts with the shield contact and not with the shield ring, the shield ring is prevented from being moved or deviated due to the friction force of the partner-side shield contact portion and therefore, the removal of the electroplated layer is prevented more surely. Further, since the shield contact is fitted into the shield ring and the shield ring is fitted (pressed) into the housing chamber, the deformation and defect of the shield contact can be prevented at the time of the pressure-insertion procedure. According to the present invention, since good contact pressure is secured by the resilient contact pieces, the electric contact performance, that is, shielding performance is improved. Further, since the resilient contact pieces absorb the friction force and the prying force between the partner-side shield contact portion and the shield contact, such forces are prevented from being transmitted to the shield ring, whereby the shield ring is prevented from being moved or deviated and further the conductive electroplated layer is prevented from removal. According to the present invention, since the shield contact can slide within the predetermined range, the shield contact can absorb the friction force and the prying force between the partner-side shield contact portion and the shield contact at the time of attaching the connectors thereby to prevent the transmission of such forces to the shield ring. Thus, the shield ring is prevented from being moved or deviated and further the conductive electroplated layer is prevented from removal. According to the present invention, the shield contact can be easily fitted into the shield ring since the diameter of the shield contact can be reduced. Further, since the diameter of the shield contact can be increased within the shield ring, the shield contact closely contacts with the shield ring, so that the electric contact performance, that is, the shielding performance can be improved. According to the present invention, the shield contact can be stably held within the shield ring, whereby the shield contact is prevented from slipping out or being largely deviated, and therefore, the stable electric contact can be realized. According to the present invention, since the shield ring is surely fixed within the housing chamber and prevented from being deviated, the conductive electroplated layer is prevented from removal. Further, the shield ring can be easily assembled by pressing the shield ring into the housing chamber.

What is claimed is:

1. A shield connector, comprising:

a connector housing including a housing chamber therein, said housing chamber having an inner peripheral wall, and a conductive electroplated layer on said inner peripheral wall of said housing chamber;

a conductive shield ring, into which a shield contact portion of a partner-side shielded connector is insertable, said conductive shield ring being fitted into the housing chamber and contacting with the conductive electroplated layer of the connector housing; and a conductive shield contact mounted on an inside of the shield ring, the shield contact for contacting with a shield contact portion of the partner-side shielded connector when the shield contact portion of the partner-side shielded connector is inserted into the shield ring, wherein the shield contact includes a split portion providing resilience to the shield contact in a direction to which a diameter of the shield contact expands, and wherein a terminal extends from said connector housing into said conductive shield contact.

2. The shielded connector of claim 1, wherein the shield contact has resilient contact pieces.

3. The shielded connector of claim 2, wherein the shield contact is slidable in a predetermined range within the shield ring.

4. The shielded connector of claim 3, wherein the shield contact has an annular shape.

5. The shielded connector of claim 2, wherein the shield contact has an annular shape.

6. The shielded connector of claim 1, wherein the shield contact is slidable in a predetermined range within the shield ring.

7. The shielded connector of claim 6, wherein the shield contact has an annular shape.

8. The shielded connector of claim 1, wherein the shield contact has an annular shape.

9. The shielded connector of claim 1, wherein the shield contact and the shield ring include locking mechanisms, respectively.

10. The shielded connector of claim 1, wherein a pressure-insertion space is formed within the housing chamber, and a pressure-insertion portion for the pressure-insertion space is formed on the shield ring.

* * * * *